United States Patent [19]

Talmadge

[11] 4,036,517

[45] July 19, 1977

[54] ROTARY DOOR LATCH

[76] Inventor: Samuel I. Talmadge, 1350 Almayo Ave., Los Angeles, Calif. 90064

[21] Appl. No.: 660,111

[22] Filed: Feb. 23, 1976

Related U.S. Application Data

[63] Continuation-in-part of Ser. No. 577,180, May 14, 1975, abandoned.

[51] Int. Cl.[2] ..... E05C 19/02

[52] U.S. Cl. ..... 292/216

[58] Field of Search ..... 292/216, 280, 198, 78, 292/79, 207, 278, DIG. 32, DIG. 47

[56] References Cited

U.S. PATENT DOCUMENTS

| | | | |
|---|---|---|---|
| 469,313 | 2/1892 | Wright | 292/280 |
| 1,711,213 | 4/1929 | Smith | 292/207 |
| 1,785,914 | 12/1930 | Riel | 292/280 |
| 2,830,843 | 4/1958 | Seaburg et al. | 49/141 X |
| 2,848,263 | 8/1958 | Miller | 292/216 X |

*Primary Examiner*—Richard E. Moore
*Attorney, Agent, or Firm*—Christie, Parker & Hale

[57] ABSTRACT

A latch carried by a door is rotatable about a vertical axis. The rotary latch member has a portion which engages a stationery striker plate on the door jamb which rotates the latch as the door moves to the closed position. Rotation of the latch causes a notch in the latch to engage either side of a post in the striker plate. The latch member continues to rotate until the door is fully closed by the interaction of the post with the notch. A releasable detent member locks the rotary latch against further rotation in either direction when the door reaches the fully closed position.

14 Claims, 11 Drawing Figures

ROTARY DOOR LATCH

FIELD OF THE INVENTION

This invention relates to door latches, and more specifically to a rotary latch for standard doors in houses and other buildings.

RELATED CASE

This application is a continuation-in-part of application Ser. No. 577,180, filed May 14, 1975 now abandoned.

BACKGROUND OF THE INVENTION

The design of latches for doors has taken a variety of forms, the most common being the horizontal spring bolt which is depressed by the striker plate and then pops into an opening in the striker plate when the door is fully closed. This type of spring latch has a number of disadvantages in that it is difficult to adjust except by repositioning the stop or the striker plate on the jamb, giving rise to the problem of a door which rattles. Unless some positive latching control is used, the spring bolts can be easily wedged or deflected by a wire, plastic card, or other metal devices to permit the door to be opened even though the mechanism controlling the latch is locked. This has given rise to the use of "dead bolt" type latches particularly for outside doors to provide a positive locking action.

Various types of rotary latches have heretofore been proposed, particularly for use with automobile doors where alignment problems and other safety considerations impose special requirements. However, such rotary latch arrangements have generally been too complicated or expensive, or difficult to install to be useful with common household doors. A rotary door latch mechanism, for example, as is described in U.S. Pat. No. 1,711,213 requires the door to close against a stop. It does not provide a flush, smooth external appearance either with the door open or closed, since the keeper requires a striking lip which must project toward the door and requires an exposed opening in the jamb adjacent the door.

SUMMARY OF THE INVENTION

The present invention provides a rotary type latch for use with household doors which provides a number of advantages over conventional spring bolt or dead bolt latches commonly found in use, yet is simple and therefore less costly to manufacture and also is easy to install. The rotary latch is designed to interface with existing door knob controls and standard locking systems. It provides a positive latching device which cannot be forced open by plastic cards or other metal devices inserted between the door and the jamb. The latch is relatively silent in operation and requires a minimum of physical effort to operate the latch. The latch is capable of accommodating a relatively large tolerance range in the spacing between the edge of the door and the jamb and yet provides a smooth external edge with a flush face plate on the jamb.

These and other advantages are achieved by providing a door closure in which a striker plate mounted on the jamb has a pair of openings forming a vertically extending post between the openings. A latch assembly mounted in the opposing edge of the door has a rotary latch member pivotally supported on a vertical axis. The latch member is rotated between open and closed positions, first by a portion projecting beyond the edge of the door which engages the edge of the striker plate as the door is moved towards the closed position, and then by a notch in the latch member which is rotated into engagement with the post. When the door is in the fully closed position, a releasable detent locks the rotary latch member against further rotation in either direction. The engagement of the latch member with the post secures the door in the closed position. On release of the detent and opening of the door, the rotary latch member returns to its initial open position by the action of a spring. The latch assembly can be inserted in a round bore drilled in the edge of the door, making the assembly easy to install. The rotary latch uses a face plate that is mounted flush with the opposing jamb, giving a smooth, attractive appearance when the door is either in the closed or open positions.

DESCRIPTION OF THE DRAWINGS

For a better understanding of the invention reference should be made to the accompanying drawings, wherein.

DETAILED DESCRIPTION

Figure 5:
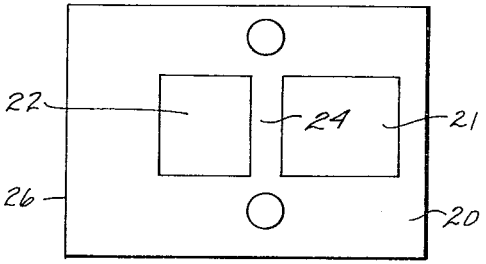
FIG. 5 is an elevational view of the striker plate.
Figure 4:
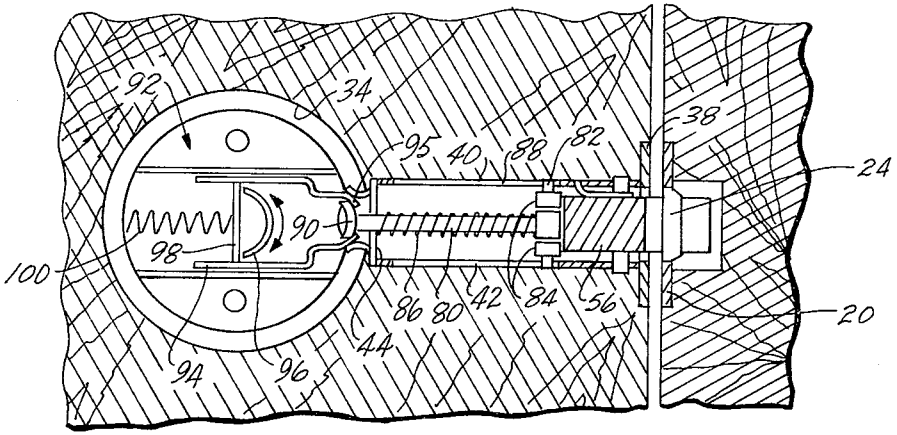
FIG. 4 is a sectional view taken substantially on the line 4—4 of FIG. 3.
Figure 6:
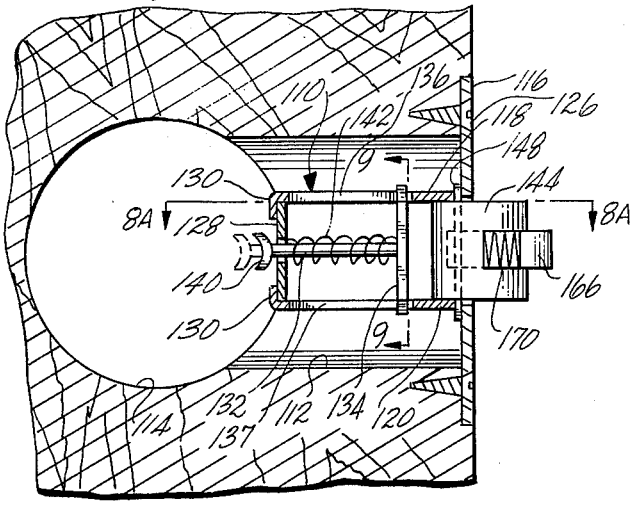
FIG. 6 is a side elevational view partly in section of an alternative embodiment of the invention.
Figure 7:
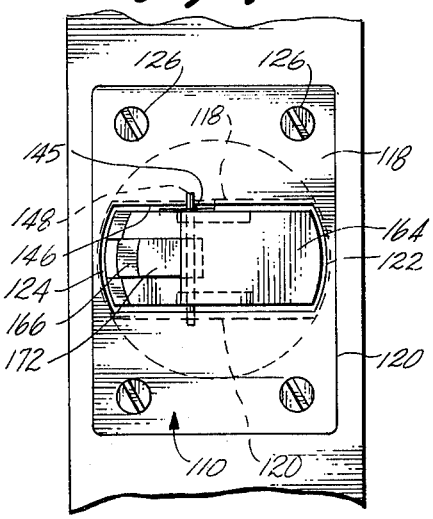
FIG. 7 is an edge view of a door with the latch installed.

Referring to the drawings in detail, the numeral 10 indicates generally a door, such as a conventional panel or hollow core door commonly used in building construction. The door is hinged along one edge by suitable hinges 12 to the door frame 14. The opposite side of the door frame includes a jamb 16. The edge of the jamb, at the desired height above the floor at which the latch is located on the door, is recessed at 18, and a striker plate 20 is secured to the jamb so as to bridge the recess 18. As shown in FIG. 5, the striker plate is provided with a pair of rectangular openings 21 and 22, a post 24 being formed between the two openings which extend vertically. The striker plate 20 has a curved lip or edge 26 which is turned in toward the jamb for engaging the latch when the door is moved toward the closed position.

The door directly opposite the striker plate 20 is also provided with a recess 30 which is semi-cylindrical in shape and having an inwardly directed passage 32 which intersects a large circular bore 34 passing through the face of the door. A latch assembly, indicated generally at 36, is mounted in the recess 30, the latch assembly having a facing plate 38 which is mounted flush with the edge surface of the door.

The assembly 36 includes a housing formed from an upper wall 40 and lower wall 42 which are secured in parallel relation to the face plate 38. The housing extends through the bore 34 and terminates in an end wall 44 which is substantially tangent to the surface of the bore 34 in the door. The top and bottom walls 40 and 42 are joined by sidewalls 48 and 50 which include arcuate portions 52 and 54 that terminate at the face plate 38.

Figure 1:
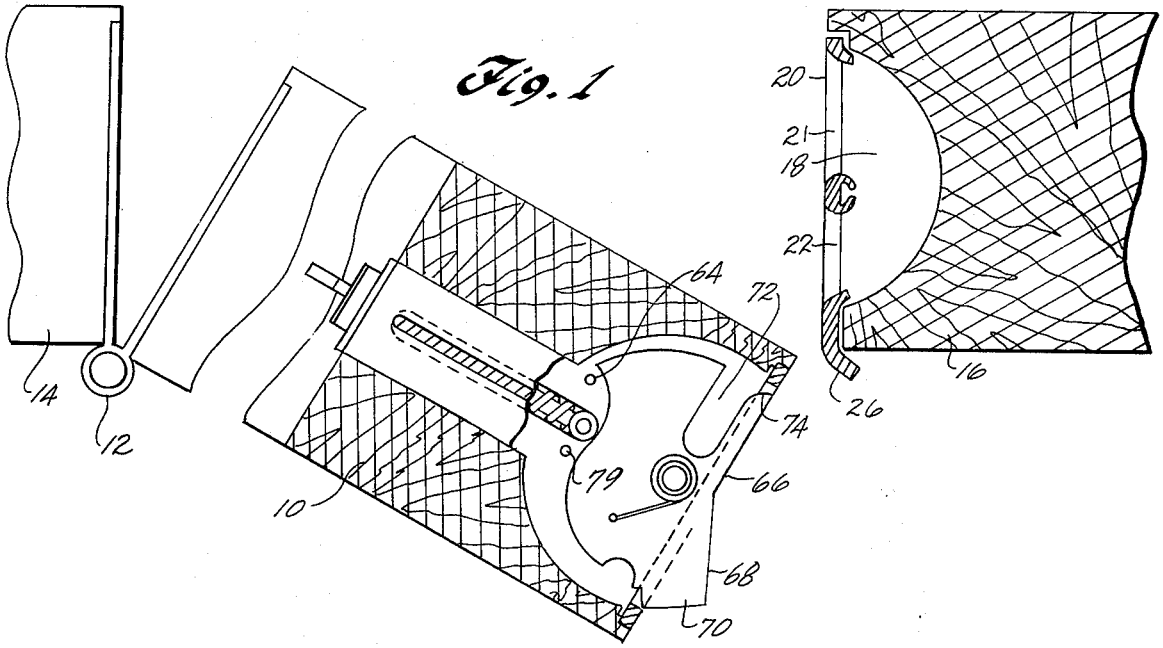
FIGS. 1, 2, and 3 are top views in section showing the latch in the open, partially closed, and fully closed positions.

The arcuate portions 52 and 54, together with the top and bottom walls 40 and 42, form a semi-cylindrical chamber in which is mounted a rotary latch member 56. The latch member 56 rotates about a vertical axis on a shaft 58, the ends of which are journaled in the top and bottom walls 40 and 42. A return spring 62 has turns extending around the shaft 58 with one end anchored to the rotary latch member 56 and the other end anchored to the frame. The spring 62 urges the rotary latch member 56 to rotate in a counterclockwise direction as viewed in FIGS. 1–3. This brings the rotary latch member 56 against a stop 64 when the door is in the open position, as shown in FIG. 1. In this position, the rotary latch member has a flat surface 66 which is flush with the face plate 38 and radially extending surface 68, forming a large obtuse angle to the surface 66. The surface 68 is defined by a portion 70 which projects outwardly of the face plate 38 in position to engage the lip 26 of the striker plate 20 when the door is moved toward a closed position.

The latch member has a radial notch 72, the centerline of the notch passing through the axis of rotation of the latch member. The notch 72 is immediately adjacent to surface 66, which is parallel to the sides of the notch. Where the side of the notch joins the outer periphery adjacent the surface 66, it is rounded off, as indicated at 74.

Figure 2:
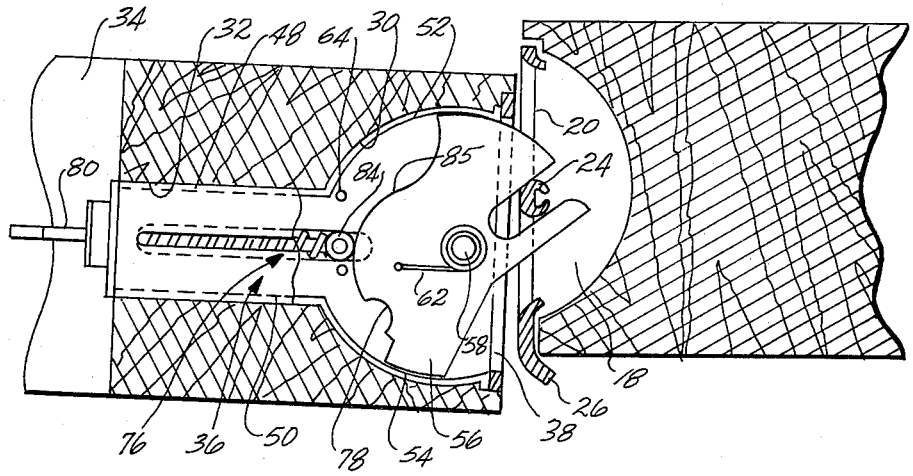
Figure 3:
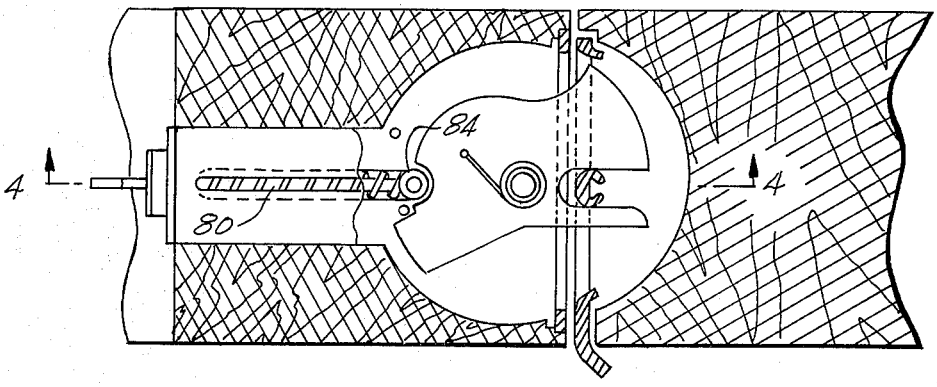

When the door 10 is moved to the closed position and the surface 68 comes in contact with the lip 26, the latch member 56 is caused to rotate in a clockwise direction against the action of the spring 62. This causes the rounded edge 74 at the outer end of the notch 72 to be rotated into the opening 22 in the striker plate. As the door continues to close, the post 24 engages the notch 72, as shown in FIG. 2. When the door is fully closed, the latch 56 has been rotated through substantially 90° to the position shown in FIG. 3. In this position, a detent mechanism, indicated generally at 76, engages a notch 78 on the edge of the rotary latch member 56, locking the rotaty latch member against rotation in either direction. Thus the door is secured in position by the engagement between the notch 72 and the post 24. A stop 79 limits rotation of the latch member in the clockwise direction.

The detent mechanism 76 includes a plunger 80 which is joined at one end to a transverse shaft 82 on which are journaled a pair of rollers 84 that are in rolling engagement with the peripheral surface of the latch member 56. The plunger 80 extends through an opening in the end member 44 of the frame, and a coil spring 86 urges the plunger toward the rotary latch member 56. The cross-sectional shape of the plunger and shape of the opening are preferably rectangular to prevent rotation of the plunger. The outer ends of the shaft 82 engage slots 88 in the top and bottom walls 40 and 42 for guiding the plunger. The rollers 84 engage a peripheral cam surface 85 extending around the back portion of the latch member 56. The radial distance of the surface 85 from the axis of rotation increases toward the notch 78, which acts to compress the spring 86 and gradually increase the resistance to rotation of the latch member as the door approaches the fully closed position.

The plunger 80 has a T-shaped end 90 extending into the bore 34. This enables the latch to be used with a conventional door knob assembly 92 inserted in the bore 34 after the latch assembly 36 is mounted in position. The door knob assembly includes a slide member 94 having a pair of fingers 95 which extend around the back side of the T-shaped end 90 of the plunger 80 when the door knob assembly 92 is inserted in the bore 34. The door knobs rotate an arcuate member 96, the ends of which engage a cross portion 98 of the slide member 94. Thus rotation of the arcuate member 96 in either direction urges the slide member against a spring 100 and, by means of the fingers 95, thereby moves the plunger 80 to release the detent and unlatch the door.

An alternative embodiment of the present invention is shown in FIGS. 6 through 9. The latch assembly, indicated generally at 110, is arranged to fit into a cylindrical bore 112 drilled into the edge of the door, the diameter of the bore 112 being somewhat smaller than the thickness of the door. The bore 112 intercepts a second bore 114 of larger diameter drilled in the face of the door for receiving a conventional door knob assembly (not shown). The rotary latch assembly has a housing including a face plate 116, flat top and bottom walls 118 and 120 and cylindrically contoured side walls 122 and 124 of slightly smaller radius than the bore 112. Thus the housing can be readily inserted in the bore. The face plate 116 is recessed in the edge of the door and secured in place by suitable wood screws at the four corners of the face plate, as indicated at 126.

The housing has a back plate 128 which is held in place against the back edges of the side walls 122 and 124 of the housing by providing tabs 130 extending from the edges of the flat top and bottom walls. The tabs 130 are crimped over after assembly to lock the back plate in place. A plunger 132 extends through an opening in the back plate 128 and forms a T-connection with a latch pin 134. The ends of the latch pin 134 are guided in slots 136 and 137 in the top and bottom walls 118 and 120. The outer end of the plunger 132 has a T-shaped end 140 adapted to engage a conventional door knob assembly (not shown). A concentric coil compression spring 142 urges the latch pin toward a rotary latch member 144.

Figure 8A:
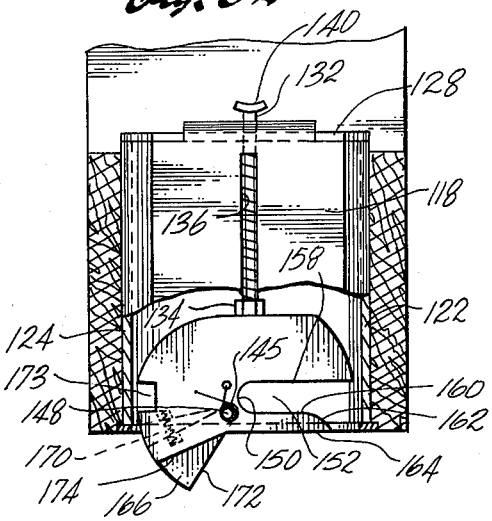
FIGS. 8A and 8B are top views in sections showing the latch in the open or unlatched position and the latched position, respectively.
Figure 8B:
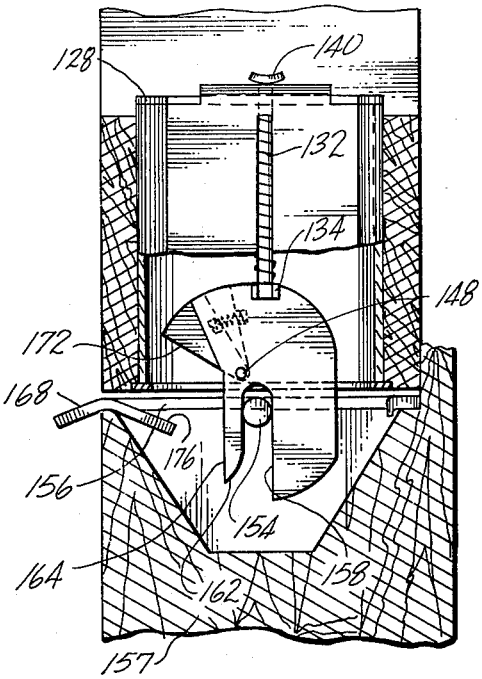
Figure 10:
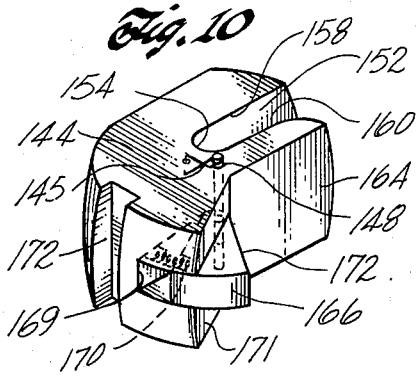
FIG. 10 is a perspective view of the rotary latch member.
Figure 9:
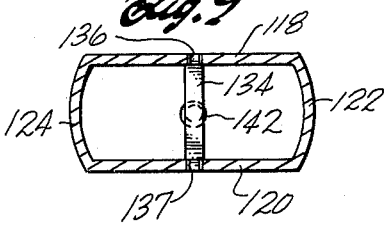
FIG. 9 is a sectional view taken substantially on the line 9—9 of FIG. 6.

The rotary latch member 144 projects through an elongated opening 146 in the face plate conforming to the interior cross sectional shape of the housing. A hinge pin 148 extends through the rotary latch 144, the pin being journaled in aligned holes in the top and bottom walls 118 and 120 of the housing. The rotary latch 144 has the axis of rotation offset from the vertical centerline of the housing, as viewed in FIG. 7. The rotary latch rotates against the urging of a spring 145 about the offset hinge pin 148 through substantially 90° when going from the unlatched to the latched position, as shown respectively in FIGS. 8A and 8B. This causes the inner end 150 of a notch 152 in the rotary latch to move through an arc. Thus the inner edge 150 moves outwardly beyond the face plate 116 toward a post 154 on the striker plate 156 mounted in the opposing jamb 157. The notch 152 itself is elongated with a pair of parallel flat surfaces 158 and 160, the surface 160 being curved outwardly, as indicated at 162, to an intersection with a flat surface 164 that normally is flush with the face plate when the rotary latch is in the unlatched position, as shown in FIG. 8A. The surface 158 extends radially outwardly from the pivot axis a greater distance than the surface 160 to insure that the post can easily move into the notch 152 as the latch member 144 rotates, as hereinafter described.

The rotary latch is rotated about the hinge pin 148 by engagement between a retractable nose member 166 coming in contact with a lip 168 of the striker plate 156 which projects beyond the front edge of the jamb. The nose portion 166 is substantially wedge-shaped and fits in a slot 169 in a projecting portion 171 of the rotary latch member 144. The retractable nose member 166 is pivotally supported on the hinge pin 148. The nose member 166 is normally urged outwardly by a compression spring 170. In its outermost position it provides a wedging surface 172 which projects at a substantial angle outwardly from the flat surface 164 of the latch member. When retracted it is flush with a surface 174 extending outwardly at a substantially smaller angle to the surface 164. The retractable nose permits a much greater tolerance in the gap between the edge of the door and the adjacent jamb and striker plate. If the gap is very small, as the latch begins to rotate on contact between the surface 172 and the lip 168, the surface 164 will rotate toward and come in contact with the inner guide 176 of the striker plate. This prevents the latch from rotating too far, but causes notch 152 to be guided toward and into engagement with the post 154. With rotation the outer end of surface 158 engages the posts and guides the post on into the slot. The retractable nose member 166 will be moved into the slot 169 against the spring 170 by the lip 168 even though the rotation of the latch is restricted by the surface 176, preventing any binding. If the gap is very wide, the retractable nose member 166 insures that the rotary latch 144 will still be rotated sufficiently by engagement with the lip 168 to rotate the point formed by the radius surface 162 past the post 154 so that the notch 152 still receives the post 154. When the door is fully closed, the latch 144 is rotated to the position shown in FIG. 8B in which the latch pin 134 drops into a notch 173 in the latch 144. This secures the door in the closed position until the latch pin 134 is retracted to release the latch.

From the above description it will be seen that a rotary latch is provided which can be easily installed by merely drilling or boring holes in the door. The latch provides positive latching action over a wide variation in spacing between the edge of the door jamb. The slot and post form a snug fit to eliminate any rattle even though the door stop is not properly fitted. The rotary latch can be use with any standard door knob assembly presently available on the market.

What is claimed is:

1. A door closure for latching a hinged door to a door jamb, comprising a striker plate on the jamb having a surface tangent to the arcuate path of the outer edge of the door, the striker plate having a pair of openings forming a vertically extending post between the openings and a lip extending beyond the edge of the jamb in the direction that the door swings open, a latch assembly mounted on the door along the outer edge opposite the position of the striker plate, the latch assembly including a frame recessed in the door, a rotary latch member pivotally supported in the frame for rotation about a vertical axis, the latch member being rotatable between an open and a closed position, the latch member having a portion projecting beyond the edge of the door toward the jamb when the latch is in the open position, the projecting portion having a surface extending outwardly in a direction away from the pivot at small angle in a direction away from the jamb to produce a wedging action when brought into contract with the lip of the striker plate as the door is moved toward the closed position, the movement of said surface of the projecting portion against the lip of the striker plate causing the latch member to rotate about said vertical axis, the rotary latch member having a notch opening radially outwardly from the pivot in a direction parallel to the edge of the door when the latch is in the open position, the relative movement between the door and striker plate rotating the latch member so that the post engages the notch causing continued rotation of the latch member to the closed position as the door swings fully shut, and releasable detent means locking the latch member in the closed position.

2. Apparatus of claim 1 further including spring means connected between the frame and latch member for urging the latch member into the open position.

3. Apparatus of claim 2 wherein said detent means includes a plunger slidably mounted in the frame and extending radially from the pivot center of the latch member, and spring means urging the plunger toward the latch member, the latch member having a cam surface against which the plunger rests, the cam surface having a detent groove into which the plunger is urged when the latch member is rotated to the closed position.

4. Apparatus of claim 3 wherein the latch member has a flat surface lying flush with the edge of the door when the latch is in the open position, said surface of the projecting portion intersecting said flat surface adjacent the pivot support of the latch member.

5. Apparatus of claim 1 wherein the projecting portion of the latch member includes a nose member normally extending beyond said surface of the projecting portion, means hingedly attaching the nose member to the latch member for rotation relative to the latch member about a vertical axis.

6. Apparatus of claim 5 wherein the nose member is rotatable about the same axis as the latch member.

7. Apparatus of claim 6 further including spring means extending between the nose member and the latch member urging the nose member in a direction outwardly of the edge of the door when the latch member is in the open position.

8. Apparatus of claim 7 wherein the spring means between the nose member and the latch member is stiffer than the spring means between the latch member and the frame, whereby the wedging force of the striker lip against the nose member causes the latch member and the nose member to rotate as a unit.

9. Apparatus of claim 1 wherein the sides of the radially extending notch are substantially parallel.

10. Apparatus of claim 9 whrein one side of the notch extends radially a greater distance than the other side of the notch.

11. A latch member for latching a door comprising a housing adapted to be mounted in a recess in the edge of the door, the housing having a face plate adapted to be mounted flush with the edge of the door with an opening therein, a rotary latch member pivotally supported by the housing and positioned in the opening for rotation about a vertical axis, a stop member supported by the housing, spring means urging the latch member to rotate in one direction against the stop, the latch member having a first portion projecting outwardly of the door through the opening on one side of the pivot axis when the latch member is against the stop, the first portion moving back into the opening when the latch member is rotated away from the stop, the latch member having a second portion moving out through the opening on the other side of the pivot axis when the latch member is rotated away from the stop, the second portion having a substantially radially extending notch fully positioned within the housing when the latch member is against the stop, and a releasable detent member engaging the latch member and locking the latch member in a latched position rotated away from the stop in which the second portion and associated notch are positioned outside the housing and the first portion is positioned inside the housing, said first portion of the latch member including a nose member projecting outwardly from the housing beyond said first portion, the nose member being pivotally supported by the latch member and rotatable relative to the latch member in the same direction as the latch member rotates about said pivot axis.

12. The latch member of claim 11 wherein the second portion of the latch member has a flat surface parallel to the face plate when the latch member is against the stop.

13. The latch member of claim 12 wherein said first portion has a flat surface intersecting the flat surface of the second portion at an obuse angle.

14. Apparatus of claim 4 wherein the striker plate includes means defining a surface extending at an angle to the edge of the door jamb in a direction away from the edge of the door and positioned to engage said surface of the latch member as the door moves the latch into contact with the striker plate for limiting rotation of the latch and guiding the notch into engagement with the post.

* * * * *